US005323219A

United States Patent [19]

Hamanaka et al.

[11] Patent Number: 5,323,219

[45] Date of Patent: Jun. 21, 1994

[54] COPYING MACHINE HAVING AN AUTOMATIC DOCUMENT FEEDER WITH ORIGINAL POSITIONING MEANS

[75] Inventors: Izumi Hamanaka; Masanobu Kawano, both of Hachioji, Japan

[73] Assignee: Konica Corporation, Tokyo, Japan

[21] Appl. No.: 32,997

[22] Filed: Mar. 18, 1993

[30] Foreign Application Priority Data

Apr. 10, 1992 [JP] Japan ..... 4-90985

[51] Int. Cl.[5] ..... G03G 21/00

[52] U.S. Cl. ..... 355/308; 355/317; 271/256; 271/258; 271/3

[58] Field of Search ..... 355/308, 208, 316, 317; 271/3, 3.1, 4, 7, 226, 256, 258

[56] References Cited

U.S. PATENT DOCUMENTS

| | | | |
|---|---|---|---|
| 4,455,018 | 6/1984 | Colglazier et al. | 355/317 X |
| 4,579,444 | 4/1986 | Pinckney et al. | 355/317 |
| 4,791,451 | 12/1988 | Hirose et al. | 271/265 X |
| 4,809,969 | 3/1989 | Bastow et al. | 271/258 |
| 5,056,775 | 10/1991 | Kida | 271/3 X |
| 5,086,319 | 2/1992 | Carolan | 355/217 |

FOREIGN PATENT DOCUMENTS

| | | |
|---|---|---|
| 52-79820 | 7/1977 | Japan . |
| 55-31550 | 7/1980 | Japan . |
| 62-59308 | 12/1987 | Japan . |

*Primary Examiner*—Benjamin R. Fuller
*Assistant Examiner*—John E. Barlow, Jr.
*Attorney, Agent, or Firm*—Frishauf, Holtz, Goodman & Woodward

[57] ABSTRACT

A copying machine is equipped with an automatic document feeder, which separates documents in a document storing section and feeds them one by one onto a platen glass. The documents are stopped at an exposure position by a document conveyance stopper, where they are exposed and scanned by an exposure scanning device, and then delivered to a document delivery tray. A sensor is provided in a feeding path of the document feeder, for detecting a leading edge or a trailing edge of the document. A delaying device for delaying a drive source stopping signal of the document conveyance stopper is outputted after a predetermined period of time has passed, or after a predetermined number of pulses have been counted after the document leading or trailing edge signal outputted from the sensor has been received. A detection device detects the documents actual stopping position and a signal is output after the drive source stopping signal of the document conveyance stopper has been generated. A controller controls the generation of a signal for the recording sheet conveyance operation. The start signal occurs at a time which corresponds to the driving of the exposure scanning device, as adjusted based on a detection at the actual document stopping position by the detection device. The document stopping position is at the location on the platen where the motor drives and transports the original plus the distance that the sheet is carried by inertia.

5 Claims, 6 Drawing Sheets

COPYING MACHINE HAVING AN AUTOMATIC DOCUMENT FEEDER WITH ORIGINAL POSITIONING MEANS

BACKGROUND OF THE INVENTION

The present invention relates to an improvement of a copying machine equipped with an automatic document feeder by which a document is automatically supplied onto the exposed surface, and particularly to a copying machine equipped with an automatic document feeder by which timing of document feeding, exposure scanning, and recording sheet feeding is automatically adjusted, and controlled so that copying productivity is efficiently increased.

The automatic document feeder for the copying machine (which will be called ADF, hereinafter) is an apparatus by which a document set in a document tray is automatically conveyed to a platen, and the document is delivered on a delivered sheet tray after the document has been copied by the copying machine. This apparatus is suitable for high speed copying of documents having many pages.

Recently, in copying machines, the following is required in order to increase the copying property high speed copying is required in order to increase the number of copied sheets per minute; a high document conveyance speed of the ADF (about 1000 to 1200 mm/sec) is required; and the times for document exchange, such as setting the document in a predetermined exposed position and delivering the document therefrom, are reduced so that the number of processed original sheets per minute (OPM) is increased.

Generally, in copying machines with ADF, there are the following methods by which a document is fed to a predetermined position on the platen glass provided on the upper surface of the copying machine and stopped thereon.

(1) An end of the document is contacted with a document positioning stopper provided on one side of the platen glass, and the document is stopped. In this method, there are the following problems: collision noises are generated when the document is contacted with the stopper; a means to prevent the document from going over a positioning plate is necessary; ends of the document are sometimes damaged; productivity is low because the document is switched back or conveyed at low speed when the document is contacted with the document positioning plate; and when a movable stopper is used for reversal conveyance of a two-sided document, the structure is complicated.

(2) In a method by which the document is stopped at a predetermined position on the platen glass by controlling a motor, without using the document positioning plate when the ADF is operated, for example, an encoder is directly coupled with the motor, and an operator stops the motor by an electromagnetic brake while monitoring a signal generated by the encoder. In this case, there are problems in which: a strong electromagnetic brake is necessary; the structure of the apparatus is complicated; and noises are generated when the magnetic brake is operated.

These are document stopping methods in the automatic document feeder(ADF). In the recording sheet feeding of the copying machine, the recording sheet supply is started in timed relation with an optical travelling system of an exposure scanning means, which is unconnected with the ADF control.

Therefore, the timing of the document conveyance by ADF is not matched with the recording sheet supply in the copying machine. In order to prevent a time lag of the image on the recording sheet, sufficient time is necessary when the document is exchanged, and therefore copying productivity, that is, a ratio of OPM (the number of original sheets conveyed per minute in ADF) and CPM(the number of sheets copied per minute in the copying machine) is lowered.

As a document feeding control apparatus, techniques in Japanese Patent Publication No. 59308/1987, Japanese Patent Publication Open to Public Inspection No. 79820/1977, and Japanese Utility Model Open to Public Inspection No. 31550/1980 have been disclosed. However, these techniques relate to document stopping control in ADF, or document jamming detection.

SUMMARY OF THE INVENTION

The object of the present invention is to solve the foregoing problems in the automatic document feeder, and to increase the number of copied sheets.

In order to accomplish the foregoing object, a copying machine with an automatic document feeder of a first embodiment of the present invention is structured as follows. The present invention provides a copying machine equipped with an automatic document feeder, in which a plurality of documents in a document storing section are separated by a document feeding means and fed one by one onto a platen glass, the document is stopped at an exposure position by a document conveyance stopping means, exposed and scanned by an exposure scanning means, and after the exposure, the document is delivered to a document delivery tray, the copying machine being equipped with an image forming means by which a document image is formed on a recording sheet by exposure scanning, the copying machine comprising: a sensor which is provided in a feeding path of the document feeding means and by which passage of a leading edge or trailing edge of the document is detected; a delay means from which a drive source stopping signal of the document conveyance stopping means is outputted after a predetermined period of time has passed, or a predetermined number of pulses have been counted after the document leading edge or trailing edge signal outputted from the sensor has been received; a detection means by which the document stopping position is detected and a signal is outputted after the drive source stopping signal of the document conveyance stopping means has been generated; and a control means by which a timing signal of a start of the recording sheet conveyance operation is generated corresponding to the drive of the exposure scanning means, and according to a value of the document stopping position detection by the detection means.

Further, according to a second embodiment of the present invention, a copying machine is structured in the following way: a document travelling distance from the position of the sensor to the document stopping position is found by the detection means by counting pulses outputted from an encoder directly coupled with the drive source.

Furthermore, according to a third embodiment of the present invention, the copying machine comprises a delay means composed of: an encoder directly coupled with a motor of the drive source; and a counting control means.

DETAILED DESCRIPTION OF THE PREFERRED EMBODIMENTS

Figure 1:
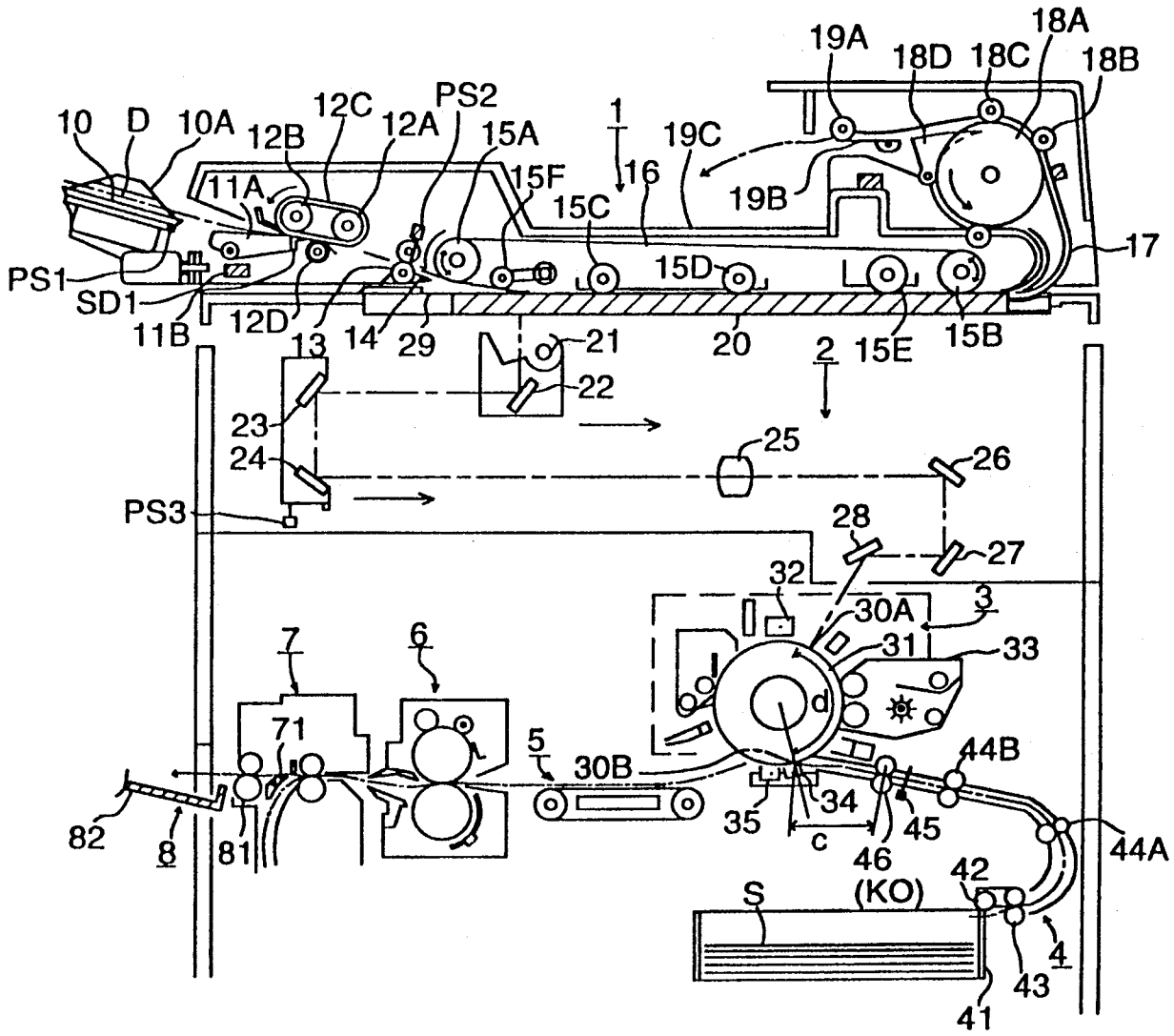
FIG. 1 is a view showing an entire structure of the copying machine equipped with an automatic document feeder according to the present invention.

Referring to the drawings, the present invention will be described in detail as follows.

Figure 2:
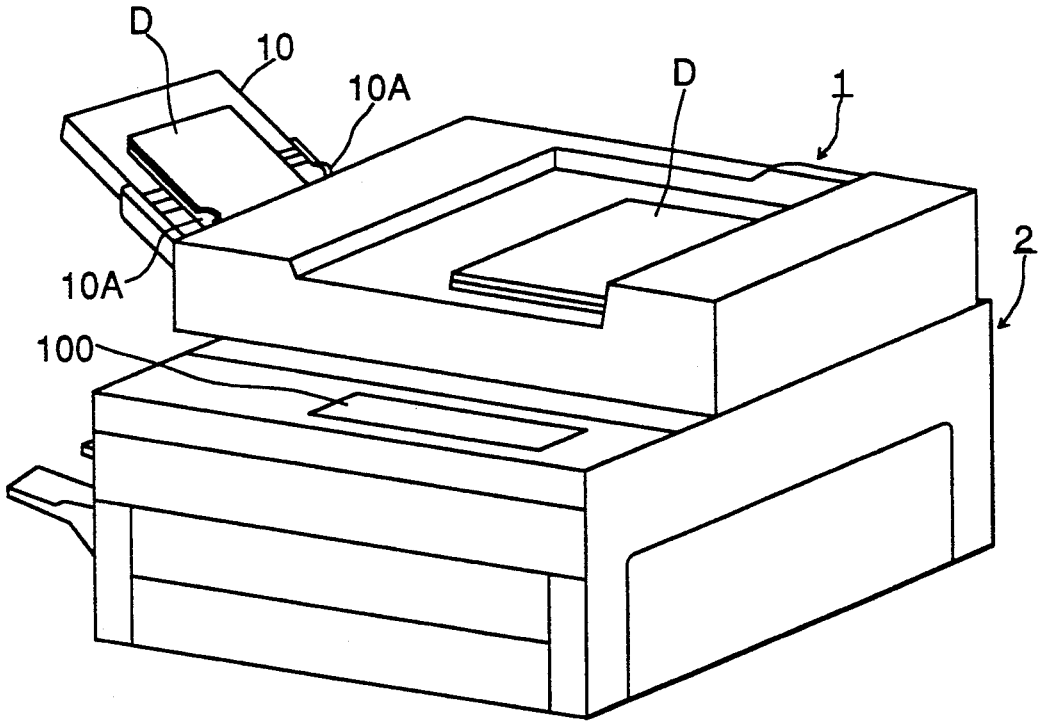
FIG. 2 is a perspective view showing the appearance of the copying machine.

FIG. 1 is a view showing an entire structure of the copying machine equipped with an automatic document feeder according to the present invention. FIG. 2 is a perspective view showing the appearance of the copying machine equipped with the automatic document feeder.

In these drawings, numeral 1 is an automatic document feeder provided with an automatic two-sided document reverse function, and numeral 2 is an optical exposure scanning system (an exposure scanning means). Numeral 3 is an image forming means around a photoreceptor drum 31. Numeral 4 is a recording sheet feeding means (a sheet feeding means). Numeral 5 is a recording sheet conveyance means. Numeral 6 is a fixing unit. Numeral 7 is a reversal delivery sheet switching means. Numeral 8 is a sheet delivery means.

An automatic document feeder (ADF) 1 of the present invention is provided on a copying machine main body. The automatic document feeder 1 comprises: a document feeding section (shown in the left side of the drawing, shown by numerals 10 to 14) by which a document is delivered onto a platen glass 20 from a stack of documents stacked on a document tray 10; a document conveyance section (shown in the center of the drawing, shown by numerals 15 and 16) by which a document sheet fed from the document feeding section is conveyed to a predetermined position (an image exposure scanning position) on a platen glass 20; and a document delivery section (shown in the right side of the drawing, shown by numerals 17 to 19) by which the document conveyed from the document conveyance section after the image exposure has been completed is delivered to a document delivery tray 19C.

A document stack tray 10 is provided on the left side of the upper surface of the document feeding section of the automatic document feeder, and the document is stacked on the tray 10. A guide plate 11A which can be moved by a solenoid SD1, and a document leading edge stopper 11B are provided downstream of the leading end of the document stack tray 10.

When a stack of documents is stacked on the document stack tray 10, a document setting detection sensor (a document detection sensor) PS1 detects whether documents are stacked on the tray or not. After that, an ADF mode is displayed on a control panel 100 of the copying machine main body.

A document width regulation plate 10A by which the width of the document is regulated is movably provided.

A document separation means composed of a feeding belt 12C, rotated around a feeding roller 12A and an idle roller 12B, and a double-feeding protection roller 12D which is positioned on the lower side of the belt, is provided downstream of the document feeding direction. The driving force of a driving motor M, which will be described later, is transmitted to the document separation means through a document feeding clutch K1.

When a copy button on a control panel 100 of the copying machine is operated, the automatic document feeder is started. The automatic document feeder is operated when the document feeding solenoid SD1 is turned on. A leading end of the guide plate 11A linked with the solenoid is raised and the document stack is contacted with the surface of the feeding belt 12C with pressure. At the same time, a document is fed by the feeding belt 12C, the rotation of which is started by the driving force of the drive motor M (see FIG. 3). Further, only the uppermost one of a plurality of documents fed by the fixed double feeding protection roller 12D is separated and fed. At this time, feeding of the lower documents is blocked by the double feeding protection roller 12D.

A document feeding roller 13, a document passage detection sensor PS2, and a guide plate 14 are provided downstream of the document feeding direction of the document separation means. When a second clutch K2 is turned ON, and a document D is conveyed to a pair of the document feeding rollers 13, and the leading edge of the document passes sensor PS2, a first clutch K1 by which the feeding roller 12A is driven is turned OFF, and the feeding belt 12C is rotated between a one way clutch which is press-fitted into the feeding roller 12A, and a drive shaft until document D has passed them, and then the belt is stopped.

A conveyance belt 16 of the document conveyance section is stretched around a conveyance belt drive roller 15A, and idle roller 15B, three document pressing rollers 15C, 15D, and 15E, and a movable pressing roller 15F which can be pressure-contacted with and separated from the belt, and the belt can be reversibly rotated by the drive motor M (not shown in FIG. 1). The lower side running surface of the conveyance belt 16 is pressed on the surface of the platen glass 20 by the document pressing rollers 15C and 15D, and by idle roller 15E and the movable pressing roller 15F.

A document fed by the document separation means is conveyed by a pair of the document feeding rollers 13, and fed onto the platen glass 20 through the guide plate 14. Further, the document D is conveyed on the platen glass 20 while being pressed by the conveyance belt 16 which is driven at almost the same speed as the circumferential speed of the document feeding rollers 13, controlled by a control means, which will be explained later, and stopped at a predetermined exposure position.

The document D, placed at the stop position on the platen glass 20, is irradiated and exposed with an exposure lamp 21 of the exposure scanning means 2 in the copying machine main body. A latent image is formed at a position of the image formation 30A on the photoreceptor drum 31, the entire surface of which has been previously charged by a charger 32, by slit-exposure-scanning of the optical exposure scanning system composed of mirrors 22, 23, and 24 of the moving optical system, a lens 25, and fixed mirrors 26, 27 and 28. Numeral 29 is a document positioning plate by which the document D is positioned in a manual mode by which the document D is set on the platen glass 20 when ADF is not used.

The latent image formed on the photoreceptor drum 31 is formed into a toner image by a developing unit 33. The toner image is transferred onto a recording sheet S, which is fed from a sheet feed cassette 41 of the recording sheet feeding means 4 through a pick up roller 42, a double feeding preventing means 43 composed of a feed roller and a reverse roller, intermediate rollers 44A and 44B, a leading edge detection unit 45, and a register roller 46 in which a register clutch K0 is provided, at a transfer position 30B by a transfer unit 34. The recording sheet S onto which the toner image has been transferred is separated from the photoreceptor drum 31 by a separator unit 35, conveyed to a fixing unit 6 through the recording sheet conveyance means 5 and fixed. The recording sheet S which has been fixed, is selected by a switching gate 71 of a reversal delivery sheet switching means 7. In this case, a recording sheet, one side of which has been copied and on which the copying operation has been completed, or a recording sheet, two sides of which have been copied, or on which multiple-copying has been conducted, is delivered on the delivery tray or bins of a sorter (not shown in the drawings) provided outside the machine, and thus the copying cycle is completed.

On the other hand, the document D which has been exposed and scanned is conveyed on the platen glass 20 towards the right direction by the document conveyance belt 16, delivered to the outside of the machine through the guide plate 17, the reversal document delivery roller 18A, pinch rollers 18B and 18C by the document delivery roller 19A and the pressure contact lever 19B, and received on the document delivery tray 19C. In the other case, the document D is branched and conveyed when the switching gate plate 18D is switched, and turned around the reversal document delivery roller 18A. After that, the document D is reversely conveyed again on the platen glass 20, and the second surface of the document is exposed (rear surface copying). Then the document D is delivered on the document delivery tray 19C provided outside the machine, after passing through the guide plate 17 again.

Figure 3:
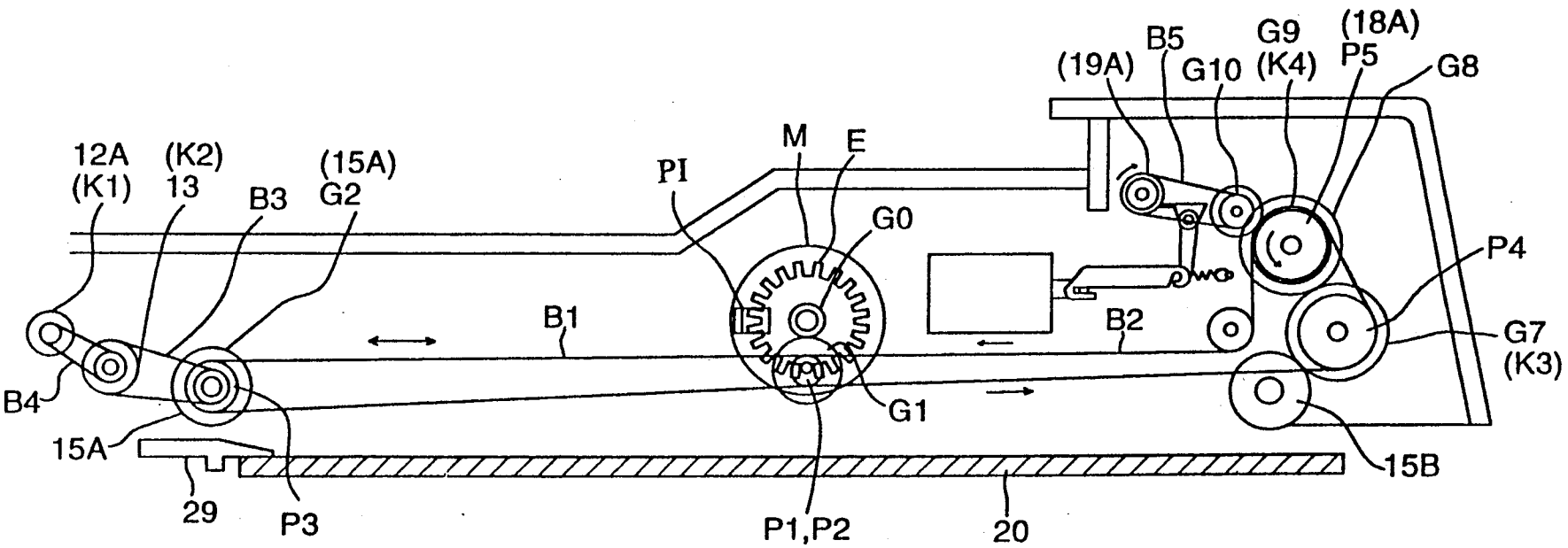
FIG. 3 is a view showing the structure of a drive system of the automatic document feeder.
Figure 4:
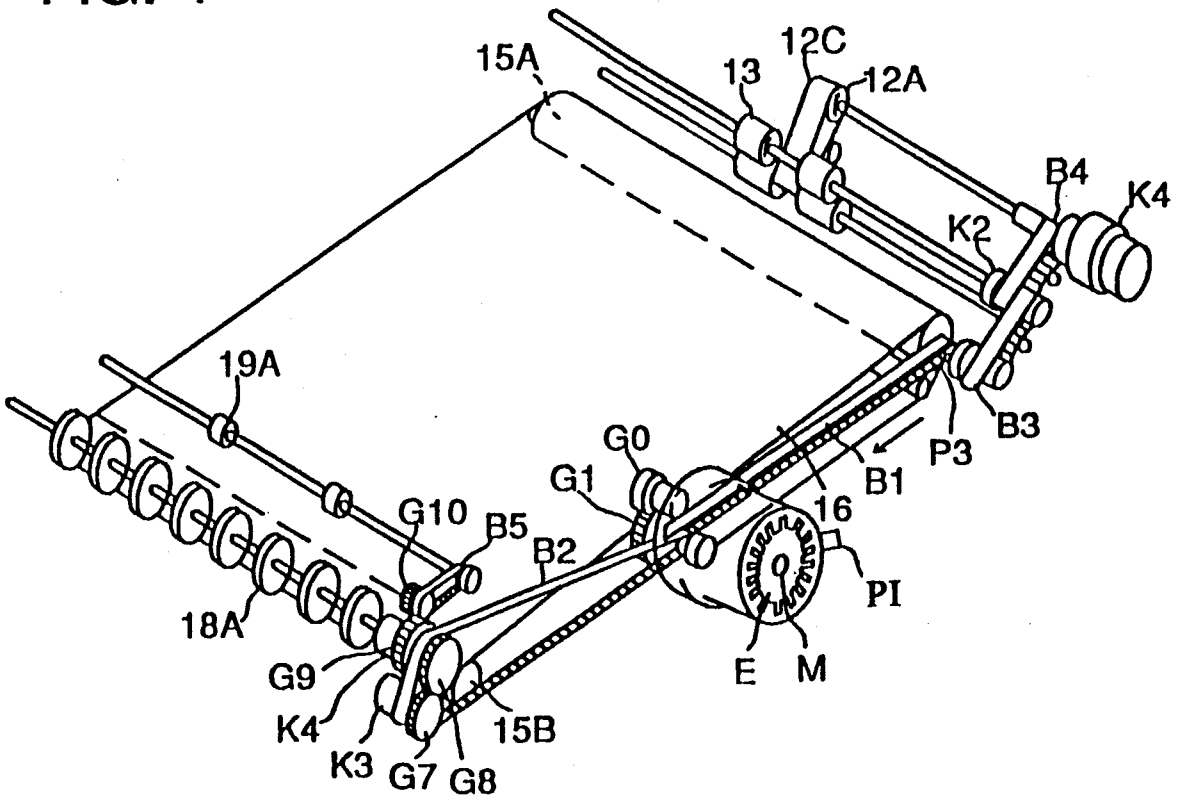
FIG. 4 is a perspective view showing the drive system.

FIG. 3 is a view showing the structure of the drive system (power transmission system) of the automatic document feeder (ADF) of FIG. 1. FIG. 4 is a perspective view viewed from rear side of the drive system.

In these drawings, a DC motor M which is a drive source, is positioned at almost the center of the drawings. Toothed pulleys P1 and P2 are rotated by the drive source through gears G0, and G1. A drive transmission system is branched into that of a toothed pulley P3 of the document sheet feeding section and that of toothed pulleys P4 and P5 of the document conveyance section by toothed belts B1 and B2.

The drive transmission system branched into the document sheet feeding section drives the drive roller 15A of the conveyance belt 16, and further drives the document feeding roller 13 through the toothed belt B3. Further, it drives the feeding roller 12A by which the feeding belt 12C is driven, through the toothed belt B4. A document feeding clutch K1 is provided on a pulley of the shaft end of the feeding roller 12A, and is free except when the document is fed.

On the other hand, the drive transmission system branched from the pulley P1 through the belt B2 into the document delivery section, drives the reversal document delivery roller 18A via pulleys P4, P5, and gears G7 and G8. Further the document delivery roller 19A is driven through gears G9, G10, and the belt B5. A one way clutch K3 is provided in the gear G7, and a one way clutch K4 is provided in the gear G9. Due to these clutches, the reversal document delivery roller 18A and document delivery roller 19A are always rotated in the arrowed direction in the drawings independently of the direction of rotation of the drive motor M (shown in FIG. 3).

An encoder plate E is provided on the other end of the drive shaft of the drive motor, and pulses generated by rotation are detected by a photo-interrupter PI.

Figure 5:
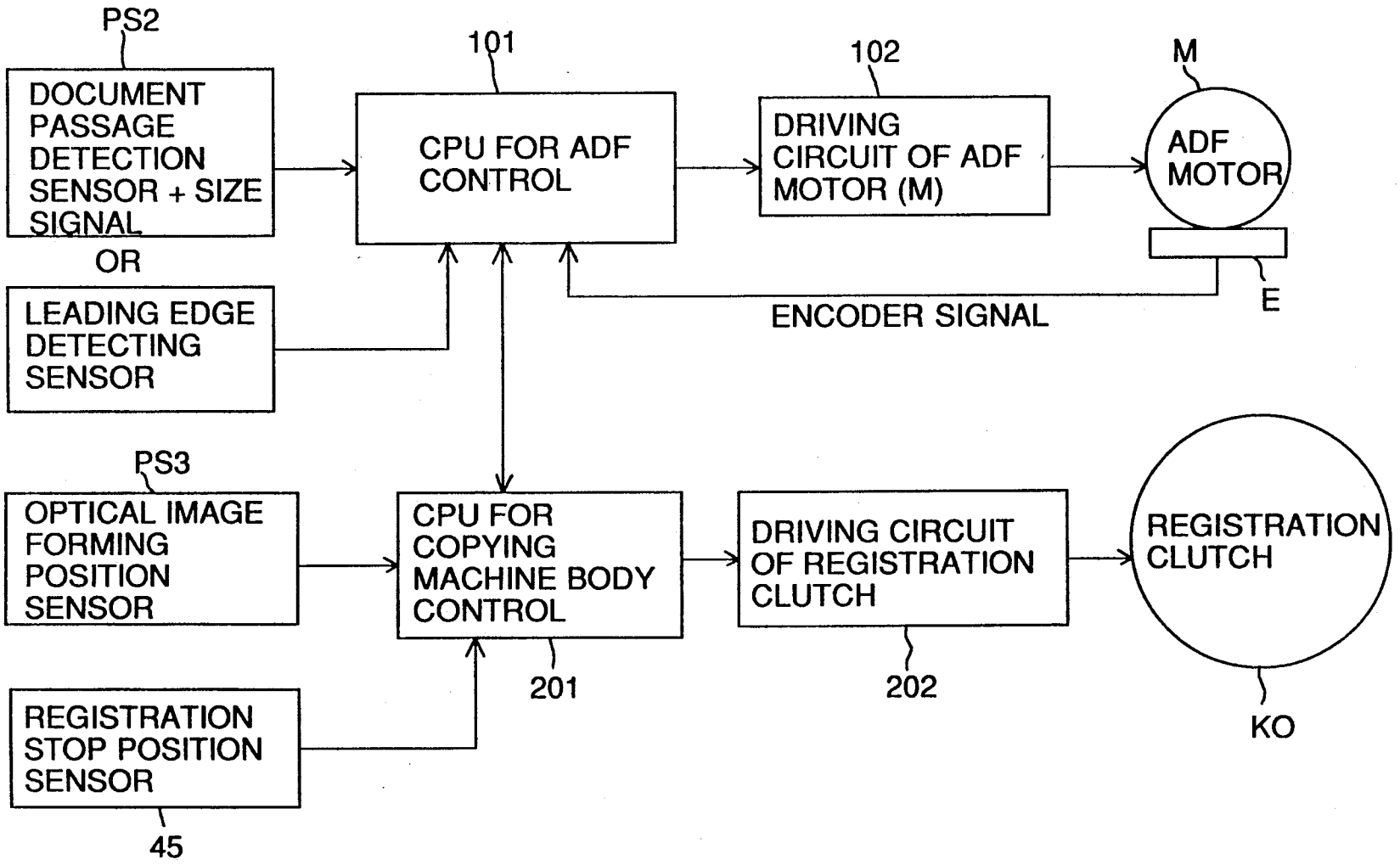
FIG. 5 is a block diagram for the control of ADF and the copying machine according to the present invention.
Figure 6:
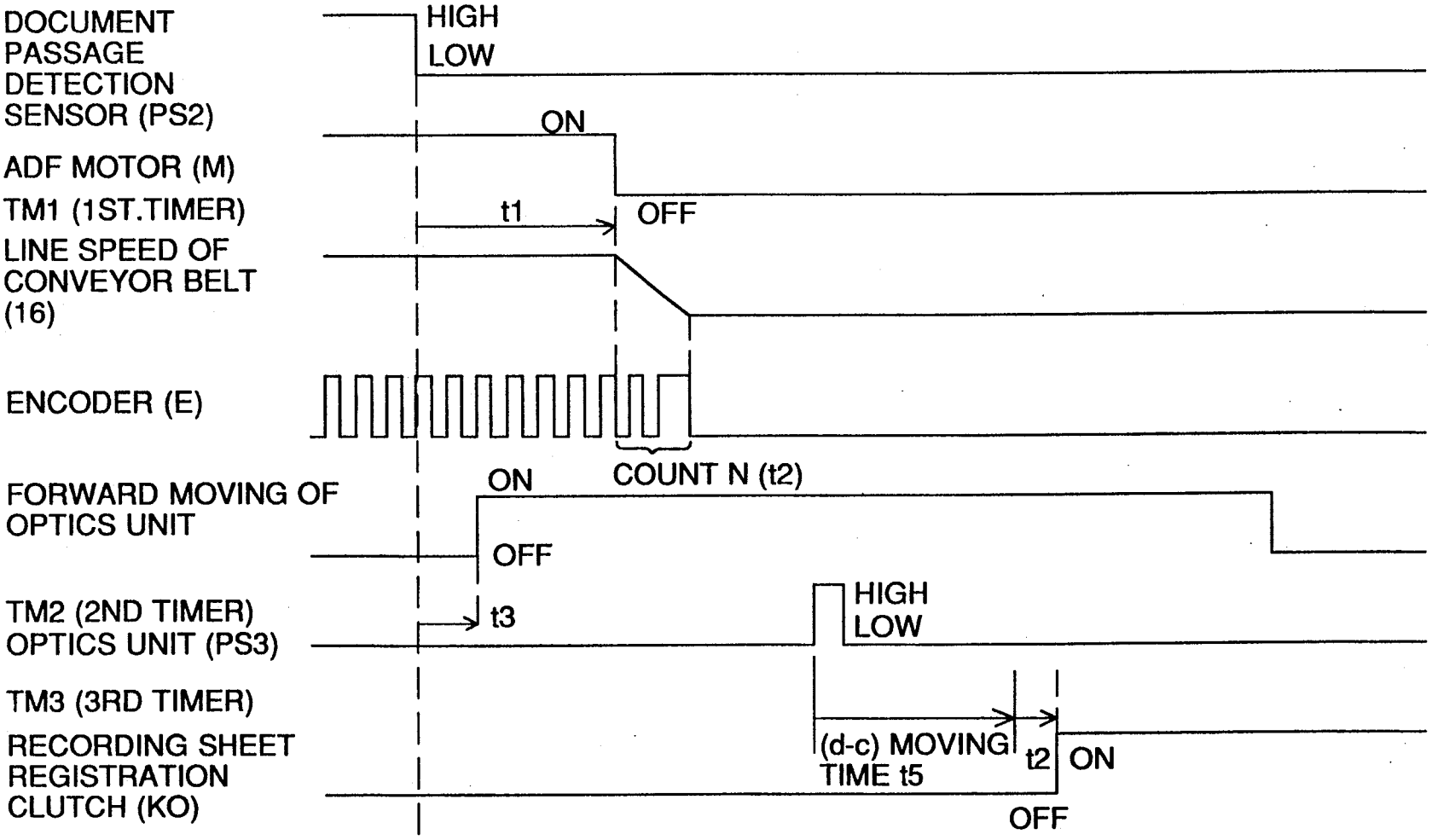
FIG. 6 is a timing chart for the control of the document conveyance and recording sheet feeding operations.

FIG. 5 is a block diagram of the control of the copying machine equipped with the automatic document feeder 1 according to the present invention. FIG. 6 is a timing chart of the document conveyance control and the recording sheet feeding control.

In a conventional copying machine equipped with the automatic document feeder (ADF), the following has been desired: the time in which the document sheet is conveyed to and contacted with the document positioning plate 29 is shortened in order to increase the productivity of the copying operation; the accuracy of the document stopping position in the ADF is increased; and the recording sheet feeding operation to the image forming section in the copying machine is in timed relation with the operation of the ADF.

The present invention provides a copying machine equipped with ADF in which: timing of the recording sheet is accurately controlled by detecting the document stopping position in the ADF; difference of the relative position between a copying image on the recording sheet and a document image caused by a time lag between the recording sheet and the document is prevented; and the copying productivity can be increased.

When the leading edge of document D, which is sent by the separation document feeding means 12(A to D) of the document feeding section (10 to 14) of ADF, is detected by a document passage detection sensor PS2 and the sensor PS2 is turned ON, a first timer TM1 starts counting. Next, the document D is fed by the document sheet feeding roller 13, and fed to the platen glass 20 after passing through the guide plate 14. Further, the document D is pressed by the conveyance belt 16 rotating at the same speed as the circumferential speed of the document sheet feeding roller 13, and is slidingly conveyed on the platen glass 20.

When the first timer TM1 has counted up a predetermined time $t_1$, the power source of the drive motor M of the ADF, by which the conveyance belt 16 is driven, is turned OFF, and the rotation is stopped. At the same time, a brake (not shown in the drawings) is operated, and the document D is suddenly stopped. In this case, a predetermined time $t_1$ may be replaced with a predetermined number of pulses. The encoder E, which is directly coupled with the drive motor M, and the photo-interrupter PI generate pulse signals while the drive motor is rotated. The pulse signals are sent to an ADF control CPU 101, and feedback control of the rotational speed is conducted. Counted up signals of the first timer TM1 are inputted into the motor driving circuit 102, and the power source of the drive motor M which is rotated at a uniform speed is turned OFF. An interval of a pulse wave form, which is equal, generated by the encoder E directly coupled with the motor M, and the photo-interrupter PI, is gradually spread until the pulse wave form disappears. Due to the foregoing, it can be confirmed that the drive motor M and the conveyance belt 16 are stopped. Pulses from the time when counting by the first timer TM1 has been completed to the time when the pulse wave form generated by the encoder E has disappeared, that is, pulses generated during the time when the document D is moved by the inertia of the conveyance belt 16 is counted. The travelling distance L of the document D after the power source of the drive motor M has been turned OFF is detected according to the number of counted pulses, and the time $t_2$ corresponding to N of the number of counted pulses is introduced by the following equation;

*the distance L = the line speed of the recording sheet × $t_2$*

After the time $t_2$ has passed, the conveyance of the document is completely stopped, and therefore, exposure scanning onto the document can be started and feeding of the recording sheet S can be started in succession.

The document D is exposed by an exposure lamp 21 of the exposure scanning means 2 provided in the copying machine main body at the stop position on the platen glass 20. The document image is formed on the photoreceptor drum 31 by the optical scanning system composed of a lens 25, mirrors 21, 22, 23, 26, 27, and 28.

The timer TM2 starts the measurement of time from the time when the document passage detection sensor PS2 is turned OFF, and a motor (not shown in the drawings) provided in the copying machine starts the drive after the time $t_3$ has been measured. When exposure scanning is started, a signal (Low→High) generated when a first mirror unit composed of, for example, the exposure lamp 21 and the mirror 22, or a second mirror unit composed of mirrors 23 and 24 passes the photosensor PS3 provided at a predetermined position, is inputted into a control CPU 201 provided in the copying machine main body.

When a third timer TM3 starts the measurement of the time from the time when the rising signal of the photo-sensor PS3 of the optical system has been generated, and a time t4 predetermined in the CPU of the copying machine main body side is counted up, a register clutch drive circuit 202 is operated, a register clutch (K0) is turned ON, and feeding of the recording sheet S is started.

The time $t_4$ is set as follows. A predetermined time $t_5$ for travelling the difference of the distance of (d-c), that is, the difference between the sheet feeding distance c from the register roller 46 shown in FIG. 1 to the transfer position 30B and the circumferential distance d of the photoreceptor drum 31 from the position of image formation 30A to the transfer position 30B, and the measuring time $t_2$ corresponding to the counted number N by the encoder E are summed up into the time $t_4$. ($t_5+t_2=t_4$). In this case, travelling distance L fluctuates depending on paper quality of documents, environmental humidity conditions, or the like. In order to bring an actual document stop position close to a target document stop position, feedback control may be conducted in the manner that a power source of a motor is turned OFF when $t_1$ is replaced with $t_{1\alpha}$ ($=t_1-t_\alpha$) which is obtained by subtracting $t_\alpha$, which is the same as the memorized time $t_2$ or close to it, from a predetermined time $t_1$. In this case, $t_4$ is expressed by the following equation:

$$t_4=t_5+t_2-t_\alpha.$$

Further, the document passage detection sensor PS2 can be used for a document leading edge detection sensor or a document trailing edge detection sensor, and therefore it can be used for the document stop control on the ADF side and the recording sheet feeding control on the copying machine side. Further it can be used also for the document size (length) detection and the document sheet jamming detection.

As described above, according to the copying machine equipped with the automatic document feeder of the present invention, a document positioning plate (stopper) is not used but a document stop position is controlled in the automatic document feeding mode. Therefore, the document conveyance and exchange time is reduced, and the copying productivity, that is, the ratio of (the number of documents fed per minute in the ADF) and (the number of sheets copied per minute in the copying machine) can be increased. Especially, in a copying machine in which high speed processing can be conducted, the copying machine of the present invention is greatly advantageous for the high speed document conveyance and high speed recording sheet feeding. Further, in the copying machine, timing of the copying image on the recording sheet with the document image is controlled, so that no difference between image positions on the recording sheet is generated. Furthermore, in the ADF mode, noises caused by a collision of the document with a stopper or the operation of a solenoid are not generated, so that silent operation can be carried out.

What is claimed is:

1. A copying apparatus comprising:

an automatic document conveyor in which a plurality of document sheets to be copied are separated by separation means and conveyed, one by one, by conveyance means of a document sheet feeder onto a platen, each of said separated document sheets being stopped by a document conveyance stopping means at an exposure position where an exposure scanning means provides an imagewise exposure of each document sheet, each imagewise exposed document sheet then being delivered to a delivery tray by delivering means, said copying apparatus also including an image forming means for forming copying images on a plurality of recording sheets by the imagewise exposure by the exposure scanning means, the copying apparatus further comprising:

(a) a sensor provided in a feeding path of said document sheet feeder, for detecting a passage of an edge portion of a separated document sheet;

(b) delay means for outputting a stop signal to stop a drive source of said document conveyance stopping means when one of (i) a predetermined period of time has passed after a detection by said sensor of the passage of the edge portion of the separated document sheet, and (ii) after a counting means counts a predetermined number of pulses from a pulse source after said sensor detects the passage of the edge portion of the separated document sheet;

(c) detecting means for detecting an actual stop position of each separated document sheet after the stop signal is output by said delay means to stop the drive source; and (d) control means for controlling a feeding of the plurality of recording sheets, said control means outputting a start signal for staring a feeding of the plurality of recording sheets by a recording sheet feeding means at a start feeding time that corresponds to a time of operation of said exposure scanning means, said start feeding time being adjusted based on a detection value that represents the actual stop position of each document sheet detected by said detecting means; and wherein said control means further controls said delay means to change a time of generation of the stop signal to stop said drive source of said moment conveyance stopping means to stop the feeding of said plurality of recording sheets by said recording sheet feeding means based on the detection value that represents the actual stop position of each document sheet; and said control means further controls a time of generation of the start signal to adjust the start feeding time of said plurality of recording sheets by the recording sheet feeding means.

2. The copying apparatus of claim 1, wherein said detecting means comprises an encoder directly connected with said drive source, for measuring a moving distance of a given document sheet between a position of said sensor and the actual stop position of said given document sheet.

3. The copying apparatus of claim 1, wherein said delay means comprises:

an encoder directly connected with said drive source; and means for controlling a counting of said pulses by said counting means.

4. A copying apparatus comprising:

an automatic document conveyor in which a plurality of document sheets to be copied are separated by separation means and conveyed, one by one, by conveyance means of a document sheet feeder onto a platen, each of said separated document sheets being stopped by a document conveyance stopping means at an exposure position where an exposure scanning means provides an imagewise exposure of each document sheet, each exposed document sheet then being delivered to a delivery tray by delivering means, said copying apparatus also including an image forming means for forming copying images on a plurality of recording sheets by the imagewise exposure by the exposure scanning means, the copying apparatus further comprising:

(a) a sensors provided in a feeding path of said document sheet feeder, for detecting a passage of an edge portion of a separated document sheet;

(b) delay means for outputting a stop signal to stop a drive source of said document conveyance stopping means when one of (i) a first predetermined period of time has passed after a detection by said sensor of the passage of the edge portion of the separated document sheet, and (ii) a counting means counts a predetermined number of pulses from a pulse source after said sensor detects the passage of the edge portion of the separated document sheet;

(c) detecting means for detecting an actual moving distance of said document conveyance stopping means caused by inertia after said stop signal has been output to stop the drive source; and (d) control means for controlling a feeding of said plurality of recording sheets, said control means controlling an outputting of a start signal for starting a feeding of a first one of said plurality of recording sheets at a register roller that is provided in a downstream feeding direction, downstream of a recording sheet feeding means;

said control means further controlling the outputting of said start signal by providing a second predetermined period of time that corresponds to a time required to travel a distance equal to a difference between (i) a sheet feeding distance as measured from said register roller to a transfer position, and (ii) a distance as measured along a circumference of a photoreceptor between an exposure position and said transfer position; and wherein said control means controls the outputting of said start signal based on said second predetermined period of time and a measured time corresponding to said detected actual moving distance detected by said detecting means.

5. The copying apparatus of claim 4, wherein said control means further controls:

a conveyance of said plurality of documents by said conveyance means such that said first predetermined period of time for a second document succeeding a first document is compensated for, based on said actual moving distance of said first document; and said outputting of said start signal for feeding a second recording sheet corresponding to said second document is set so as to provide a compensation based on said actual moving distance of said first document.

* * * * *